US010941469B2

(12) United States Patent
Wennberg et al.

(10) Patent No.: US 10,941,469 B2
(45) **Date of Patent: *Mar. 9, 2021**

(54) MARTENSITIC STAINLESS STEEL

(71) Applicant: AB SANDVIK MATERIALS TECHNOLOGY, Sandviken (SE)

(72) Inventors: Anna Wennberg, Storvik (SE); Tomas Antonsson, Sandviken (SE); Lars Nylof, Gavle (SE)

(73) Assignee: AB Sandvik Materials Technology, Sandviken (SE)

( * ) Notice: Subject to any disclaimer, the term of this patent is extended or adjusted under 35 U.S.C. 154(b) by 56 days.

This patent is subject to a terminal disclaimer.

(21) Appl. No.: 15/745,063

(22) PCT Filed: Jun. 14, 2016

(86) PCT No.: PCT/EP2016/066808

§ 371 (c)(1),
(2) Date: Jan. 15, 2018

(87) PCT Pub. No.: WO2017/009435

PCT Pub. Date: Jan. 19, 2017

(65) Prior Publication Data

US 2018/0209023 A1 Jul. 26, 2018

(30) Foreign Application Priority Data

Jul. 16, 2015 (EP) ..... 15176999

(51) Int. Cl.
*C22C 38/52* (2006.01)
*C22C 38/58* (2006.01)
(Continued)

(52) U.S. Cl.
CPC ..... *C22C 38/52* (2013.01); *C21D 1/25* (2013.01); *C21D 6/007* (2013.01); *C21D 9/22* (2013.01);
(Continued)

(58) Field of Classification Search
None
See application file for complete search history.

(56) References Cited

U.S. PATENT DOCUMENTS 5,714,114 A * 2/1998 Uehara ..... C22C 38/20 148/325
8,118,116 B2 * 2/2012 Linden ..... C21D 9/0075 148/325
2009/0013831 A1 1/2009 Linden

FOREIGN PATENT DOCUMENTS

CN 1145644 A 3/1997
CN 102586695 A 7/2012
(Continued)

OTHER PUBLICATIONS

Translation of Office Action dated Mar. 31, 2020, issued in corresponding Japanese Patent Application 2018-501864.
(Continued)

*Primary Examiner* — Anthony J Zimmer
*Assistant Examiner* — Michael J Kachmarik
(74) *Attorney, Agent, or Firm* — Morgan, Lewis & Bockius LLP

(57) ABSTRACT

The present disclosure relates to a martensitic stainless steel suitable for rock drill steel rods. Furthermore, the present disclosure also relates to the use of the martensitic stainless steel and to products manufactured thereof, especially drill rods.

18 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/18*** | (2006.01) |
| ***C22C 38/54*** | (2006.01) |
| ***C21D 1/25*** | (2006.01) |
| ***C21D 6/00*** | (2006.01) |
| ***C21D 9/52*** | (2006.01) |
| ***C21D 9/22*** | (2006.01) |
| *C21D 7/06* | (2006.01) |

(52) U.S. Cl.

CPC ..... *C21D 9/525* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 6/004* (2013.01); *C21D 7/06* (2013.01); *C21D 2211/001* (2013.01); *C21D 2211/008* (2013.01)

(56) References Cited

FOREIGN PATENT DOCUMENTS

| | | | |
|---|---|---|---|
| CN | 103614649 | A | 3/2014 |
| JP | S53-031516 | A | 3/1978 |
| JP | S58-199850 | A | 11/1983 |
| JP | S61-207550 | A | 9/1986 |
| JP | H10-504354 | A | 4/1998 |
| JP | 2018-527458 | A | 9/2018 |
| WO | 0161064 | A1 | 8/2001 |
| WO | 2009008798 | A1 | 1/2009 |
| WO | 2017/009436 | A1 | 1/2017 |

OTHER PUBLICATIONS

Chaocong Yang, et al., "Metallic Materials", Shenyang: Northeastern University Press, Apr. 30, 2014, pp. 106-108.

Office Action dated Jun. 24, 2020 issued in Chinese Application No. 201680041848.6.

* cited by examiner

MARTENSITIC STAINLESS STEEL

RELATED APPLICATION DATA

This application is a § 371 National Stage Application of PCT International Application No. PCT/EP2016/066808 filed Jul. 14, 2016 claiming priority to EP 15176999.9 filed Jul. 16, 2015.

PARTIES TO JOINT RESEARCH AGREEMENT

This invention was developed under and was made as a result of activities undertaken within the scope of a Joint Research Agreement between Sandvik Intellectual Property AB and Sandvik Materials Technology (now AB SMT), which agreement was in effect on and before the date the claimed invention was made.

TECHNICAL FIELD

The present disclosure relates to a martensitic stainless steel suitable for drill rods. Furthermore, the present disclosure also relates to the use of the martensitic stainless steel and to a product manufactured thereof, especially a drill rod.

BACKGROUND

During rock drilling, shock waves and rotation are transferred from a drill rig via one or more rods or tubes to a cemented carbide equipped drill bit. The drill rod is subjected to severe mechanical loads as well as corrosive environment. This applies in particular to underground drilling, where water is used as flushing medium and where the environment, in general, is humid. The corrosion is particularly serious in the most stressed parts, i.e. thread bottoms and thread clearances.

Normally, low-alloyed case hardened steels are used for the drilling application. Such steels have the limitation of a relatively short service life due to corrosion fatigue, which results in an accelerated breakage of the drill rod, caused by dynamic loads and insufficient corrosion resistance of the rod material. Another problem related to drill rods is the rate by which the drill rods wear out and have to be replaced due to abrasion, i.e. insufficient hardness of the rod material, which has a direct impact on the total cost for the drilling operation. A further problem related to drill rods is the strength and toughness of the rod material, especially impact toughness, i.e. the ability of the drill rod to withstand the static and dynamic loads, as well as shock loads, caused by rock drilling. If a rod breaks, it may take considerable time to retrieve it from the drill hole. The breaking of a rod may also disturb the calculated drill pattern for the optimized blasting. Additional problems relating to the breaking of drill rods and drill bits is the damage to the mining and tunnelling equipment, e.g. crushers and sieves.

Both WO0161064 and WO2009008798 disclose martensitic steels for rock drilling. Even though these steels will solve or reduce the above problem with corrosion fatigue, these martensitic steels will not possess impact toughness high enough to be fully operative during rock drilling. This will mean that the drill components made thereof will have an obvious risk of easy breakage when subjected to shock loads during rock drilling, which may lead to the same consequences as mentioned above.

Both CN 102586695 and U.S. Pat. No. 5,714,114 relate to a martensitic steel. However, the martensitic stainless steels disclosed therein are used for other applications than drill rods. Thus, the requirements and important mechanical properties of the martensitic stainless steels disclosed therein are different compared to a martensitic stainless steel used for drill rods.

Consequently, it is an object of the present disclosure to solve and/or to reduce at least one of the above-mentioned problems. In particular, it is an aspect of the present disclosure to achieve an improved martensitic steel composition with a microstructure allowing for the manufacturing of a drill rod with good corrosion resistance and well-balanced and optimized mechanical properties, thus resulting in an increased service life. A further aspect of the present disclosure is to achieve a cost efficient drill component which can be used for a long period of time.

SUMMARY

The present disclosure therefore relates to a martensitic stainless steel comprising the following in weight % (wt %):

C 0.21 to 0.27;
Si less than or equal to 0.7;
Mn 0.2 to 2.5;
P less than or equal to 0.03;
S less than or equal to 0.05;
Cr 11.9 to 14.0;
Ni more than 0.5 to 3.0;
Mo 0.4 to 1.5;
N less than or equal to 0.060;
Cu less than or equal to 1.2;
V less than or equal to 0.06;
Nb less than or equal to 0.03;
Al less than or equal to 0.050;
Ti less than or equal to 0.05;
balance Fe and unavoidable impurities;

wherein the martensitic stainless steel comprises more than or equal to 75% martensite phase and less than or equal to 25% retained austenite phase and wherein said martensitic stainless steel has a PRE-value (pitting resistance equivalent value) more than or equal to 14, the PRE value is calculated by the following equation PRE=Cr+3.3*Mo, wherein Cr and Mo correspond to the contents of the elements in weight percent (wt %); and wherein the chemical composition of the said martensitic stainless steel is within an area formed in a Schaeffler diagram, which diagram is based on the following equations:

$$Cr_{eq}=Cr+Mo+1.5*Si+0.5*Nb(x\text{-axis})$$

$$Ni_{eq}=Ni+0.5*Mn+30*N+30*C(y\text{-axis});$$

wherein the values of Cr, Mo, Si, Nb, Ni, Mn, N and C are in weight %; and which area of the martensitic stainless steel is defined by the following coordinates:

| | $Cr_{eq}$ | $Ni_{eq}$ |
|---|---|---|
| A1 | 12.300 | 9.602 |
| B1 | 12.300 | 11.990 |
| B4 | 15.702 | 9.199 |
| A3 | 14.482 | 7.864. |

The martensitic stainless steel as defined hereinabove or hereinafter has thus a hardened and tempered martensitic microstructure containing retained austenite, meaning that the martensitic microstructure comprises both martensite phase and retained austenite phase. The martensite phase will provide the desired hardness and tensile strength and also the desired resistance to wear. The retained austenite phase, which is softer and more ductile compared to the martensite phase, will reduce the brittleness of the martensitic microstructure and thereby provide a necessary improvement in the mechanical properties of the steel, such as impact toughness. The martensitic stainless steel as defined herein above or hereinafter will due to both its chemical composition and its microstructure have a unique combination of hardness, impact toughness, strength, and corrosion resistance.

Furthermore, the present disclosure also relates to the use of the martensitic stainless steel as defined hereinabove or hereinafter for manufacturing of a drill rod, such as a top hammer drill rod and water flushed top hammer drill rods, and the manufacture thereof.

DETAILED DESCRIPTION

Figure 1:
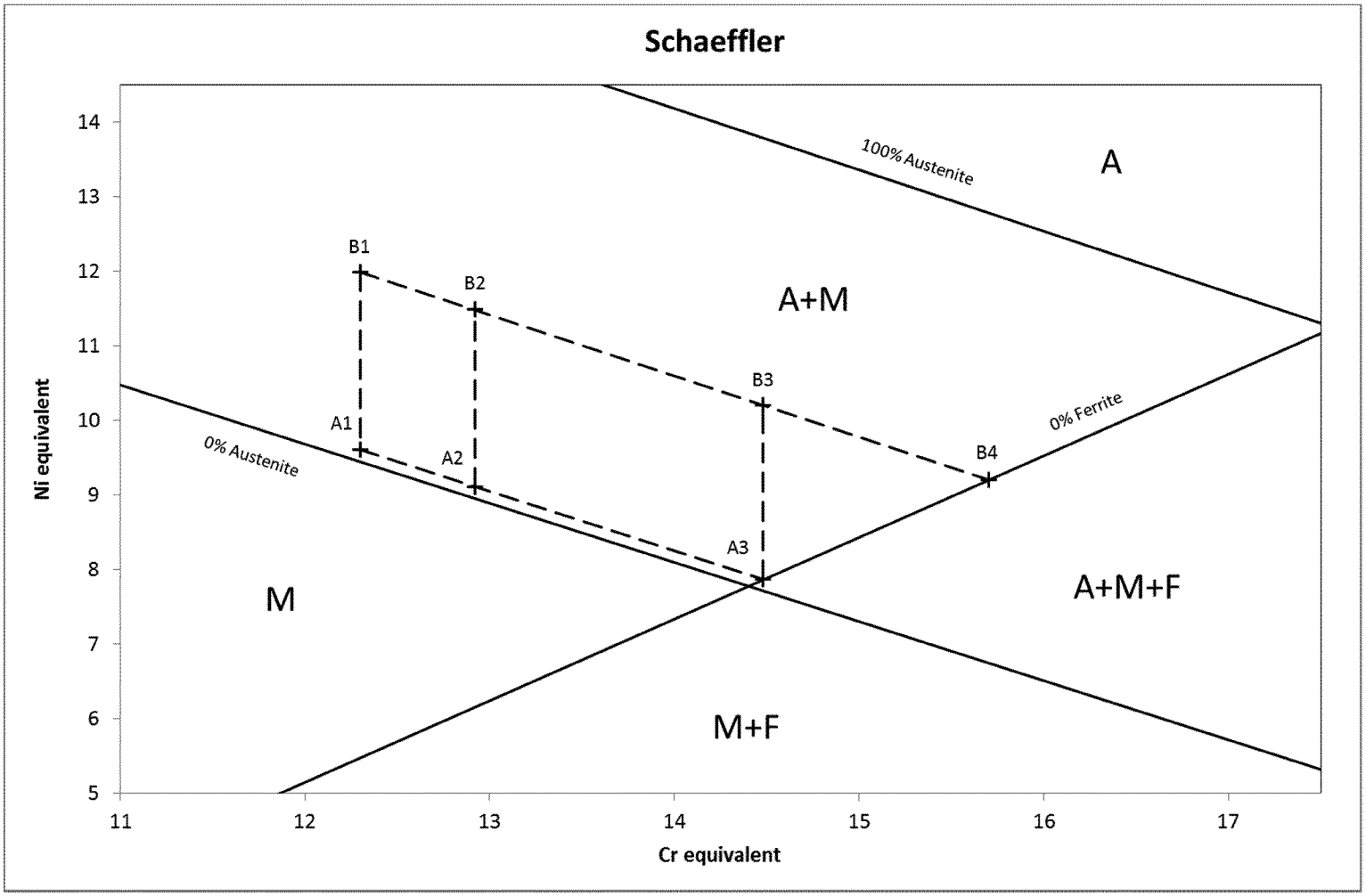
FIG. 1 shows the Schaeffler diagram wherein the area and the corresponding coordinates have been drawn

The present disclosure relates to a martensitic stainless steel having the following composition in wt %:

C 0.21 to 0.27;
Si less than or equal to 0.7;
Mn 0.2 to 2.5;
P less than or equal to 0.03;
S less than or equal to 0.05;
Cr 11.9 to 14.0;
Ni more than 0.5 to 3.0;
Mo 0.4 to 1.5;
N less than or equal to 0.060;
Cu less than or equal to 1.2;
V less than or equal to 0.06;
Nb less than or equal to 0.03;
Al less than or equal to 0.050;
Ti less than or equal to 0.05;
balance Fe and unavoidable impurities;

wherein the martensitic stainless steel comprises more than or equal to 75% martensite phase and less than or equal to 25% retained austenite phase and wherein said martensitic stainless steel has a PRE-value more than or equal to 14; and wherein the chemical composition of the said martensitic stainless steel is within an area formed in a Schaeffler diagram, which diagram is based on the following equations:

$$Cr_{eq}=Cr+Mo+1.5*Si+0.5*Nb(x\text{-axis})$$

$$Ni_{eq}=Ni+0.5*Mn+30*N+30*C(y\text{-axis});$$

wherein the values of Cr, Mo, Si, Nb, Ni, Mn, N and C are in weight %; and which area of the martensitic stainless steel is defined by the following coordinates:

| | $Cr_{eq}$ | $Ni_{eq}$ |
|---|---|---|
| A1 | 12.300 | 9.602 |
| B1 | 12.300 | 11.990 |
| B4 | 15.702 | 9.199 |
| A3 | 14.482 | 7.864. |

The present martensitic stainless steel will have high tensile strength and high wear resistance due to a high hardness of the martensite phase. The martensite phase is however brittle. In the present disclosure, it has been found that by combining the martensite phase with a certain amount of retained austenite phase (such that the microstructure comprises more than or equal to 75% martensite phase and less than or equal to 25% retained austenite phase), and further by combining this with a balanced addition of alloying elements, especially Ni, Mn and Mo, the impact toughness of the martensitic stainless steel will be greatly improved. The martensite phase will, as mentioned above, provide the desired hardness and tensile strength and also the desired resistance to wear while the retained austenite phase, which is softer and more ductile compared to the martensite phase, will reduce the brittleness of the martensitic microstructure and thereby provide a necessary improvement in the mechanical properties. It is however necessary that there is not a too high amount of retained austenite phase as this will reduce the hardness of the martensitic microstructure too much. Thus, the amount of martensite phase and the amount of retained austenite phase is as defined hereinabove or hereinafter. According to one embodiment, the martensitic stainless steel as defined hereinabove or hereinafter does not contain any ferrite phase after hardening, which in this context is considered to be a soft and brittle phase.

The martensitic stainless steel as defined herein above or hereinafter has a PRE-value which is more than or equal to 14. By having a PRE-value more than or equal to 14, the desired pitting corrosion resistance is obtained.

Figure 2:
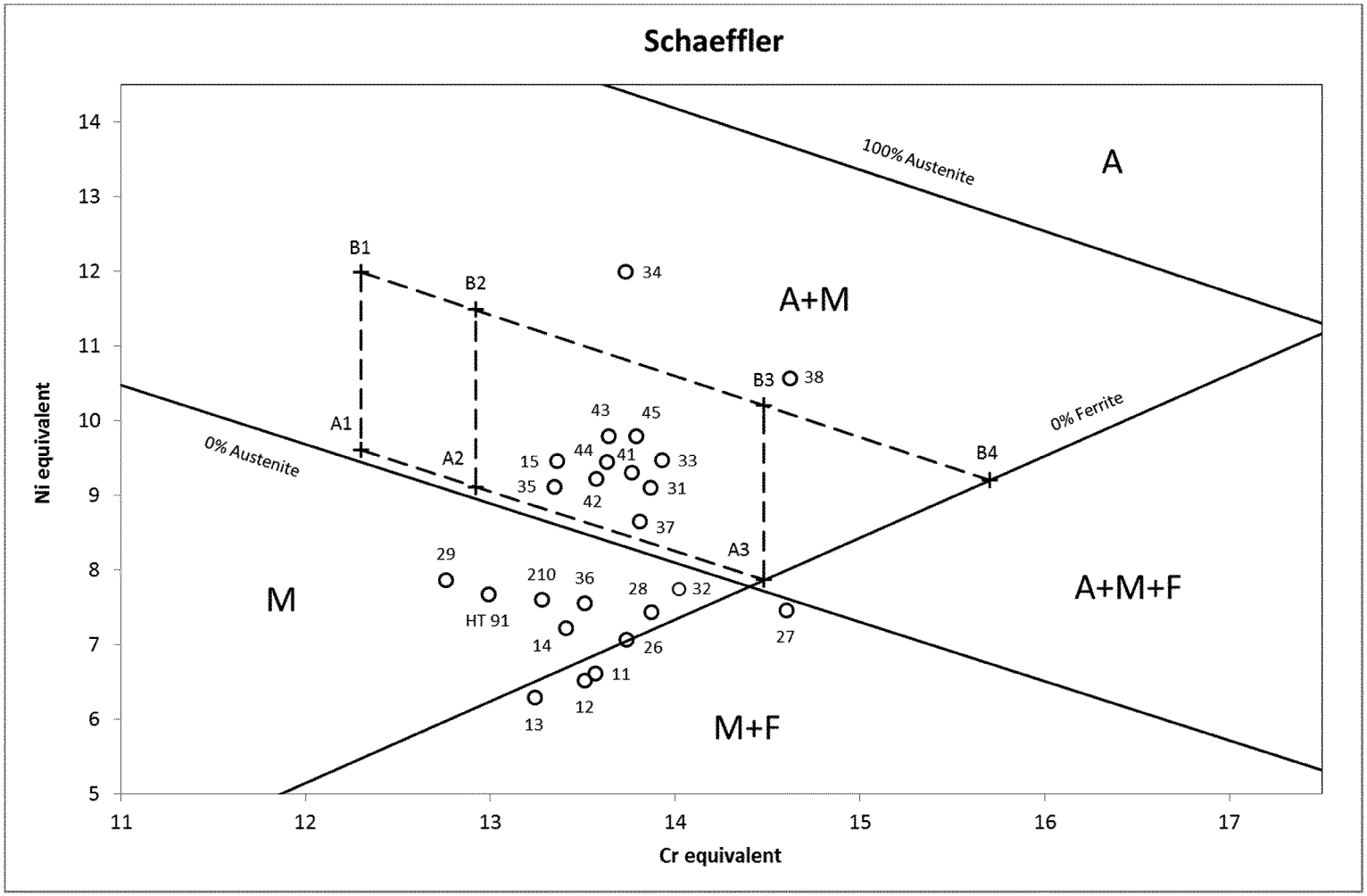
FIG. 2 shows the same Schaeffler diagram as FIG. 1 but the manufactured alloys of the Examples have been marked in the diagram
Figure 3:
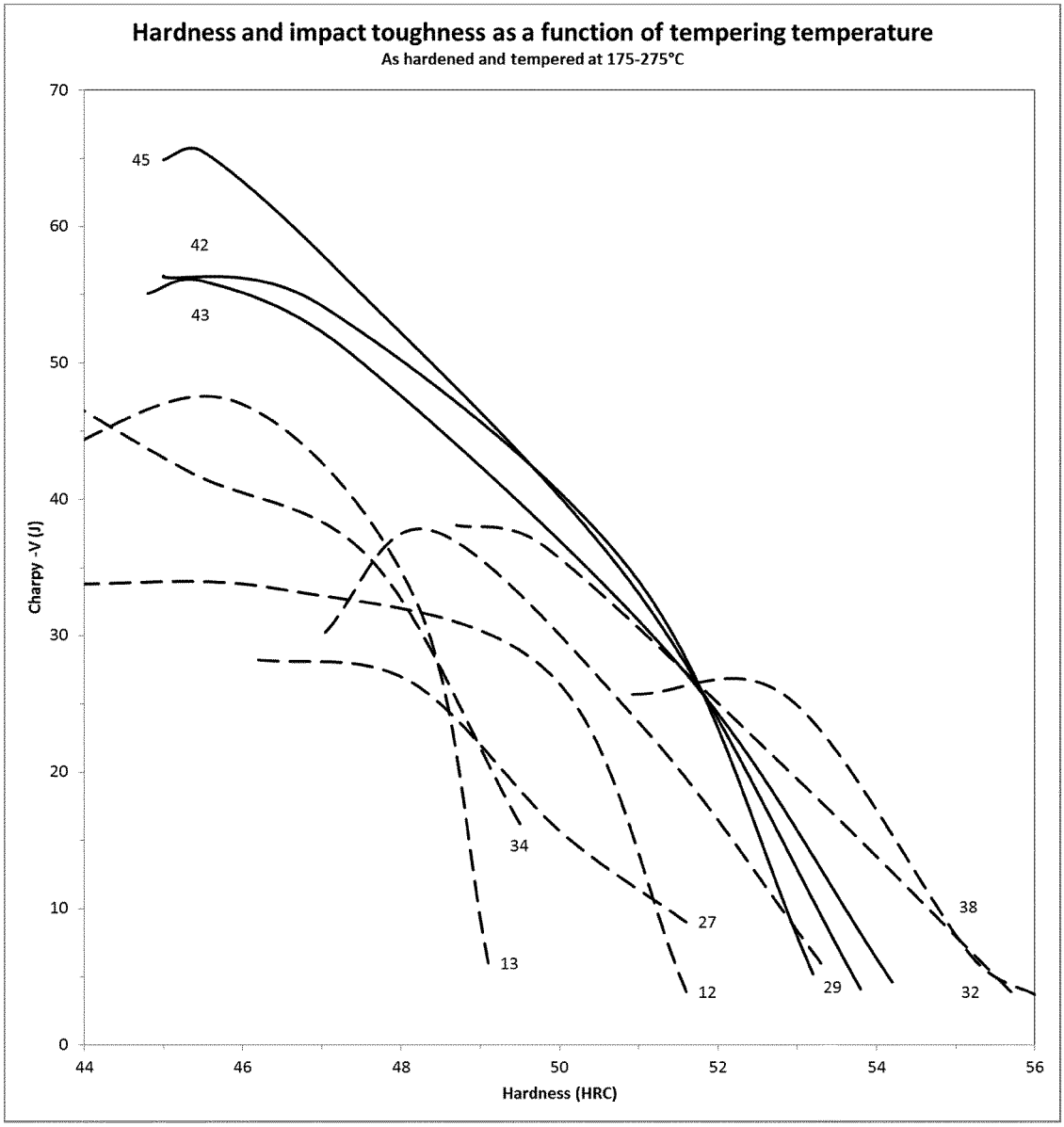
FIG. 3 shows the hardness and impact toughness curves for some of the alloys of the Examples.

Furthermore, the chemical composition of the martensitic stainless steel as defined hereinabove or hereinafter is as already stated above represented by an area defined by specific coordinates in a Schaeffler diagram according to its Cr- and Ni-equivalents (see FIG. 1). This Schaeffler diagram is used to predict the presence and amount of austenite (A), ferrite (F) and martensite (M) phases in the microstructure of a steel after fast cooling from a high temperature and is based on the chemical composition of the steel. The specific coordinates of the area of the present disclosure in the Schaeffler diagram have been determined by calculating the Cr- and Ni-equivalents ($Cr_{eq}$ and $Ni_{eq}$) according to the following equations (see FIG. 1):

$$Cr_{eq}=Cr+Mo+1.5*Si+0.5*Nb(x\text{-axis})$$

$$Ni_{eq}=Ni+0.5*Mn+30*N+30*C(y\text{-axis})$$

wherein the values of Cr, Mo, Si, Nb, Ni, Mn, N and C are in weight %; and where the area of the martensitic stainless steel is defined by the coordinates presented in FIG. 1 and FIG. 2. Hence, the present disclosure provides a martensitic stainless steel having a unique combination of high hardness and high impact toughness as well as good corrosion resistance. Further, the present disclosure provides a martensitic stainless steel having a chemical composition and microstructure giving an object made thereof an optimal combination of corrosion resistance and hardness and impact toughness throughout the whole object, whereby the cost efficiency will be much improved as well as the operation time in service.

According to another embodiment of the present disclosure, the martensitic stainless steel as defined hereinabove or hereinafter comprises of from 80 to 95% martensite phase and of from 5 to 20% retained austenite phase.

The alloying elements of the martensitic stainless steel according to the present disclosure will now be described. The terms "weight %" and "wt %" are used interchangeably:

Carbon (C): 0.21 to 0.27 wt %

C is a strong austenite phase stabilizing alloying element. C is necessary for the martensitic stainless steel so that said steel has the ability to be hardened and strengthened by heat treatment. The C-content is therefore set to be at least 0.21 wt % so as to sufficiently achieve the before mentioned effects. However, an excess of C will increase the risk of forming chromium carbide, which would thus reduce various mechanical properties and other properties, such as ductility, impact toughness and corrosion resistance. The mechanical properties are also affected by the amount of retained austenite phase after hardening and this amount will depend on the C-content. Accordingly, the C-content is set to be at most 0.27 wt %, thus the carbon content of the present martensitic stainless steel is of from about 0.21 to 0.27 wt %, such as of from 0.21 to 0.26 wt %.

Silicon (Si): max 0.7 wt %

Si is a strong ferrite phase stabilizing alloying element and therefore its content will also depend on the amounts of the other ferrite forming elements, such as Cr and Mo. Si is mainly used as a deoxidizer agent during melt refining. If the Si-content is excessive, ferrite phase as well as intermetallic precipitates may be formed in the microstructure, which will reduce various mechanical properties. Accordingly, the Si-content is set to be max 0.7 wt %, such as max 0.4 wt %.

Manganese (Mn): 0.2 to 2.5 wt %

Mn is an austenite phase stabilizing alloying element. Mn will promote the solubility of C and N in the austenite phase and will increase the deformation hardening. Furthermore, Mn will also increase hardenability when the martensitic stainless steel is heat treated. Mn will further reduce the detrimental effect of sulphur by forming MnS precipitates, which in turn will enhance the hot ductility and the impact toughness, but MnS precipitates may also impair the pitting corrosion resistance somewhat. Therefore, the lowest Mn-content is set to be 0.2 wt %. However, if the Mn-content is excessive, the amount of retained austenite phase may become too large and various mechanical properties, as well as hardness and corrosion resistance, may be reduced. Also, a too high content of Mn will reduce the hot working properties and also impair the surface quality. The Mn-content is therefore set to be at most 2.5 wt %. Hence, the content of Mn is of from 0.2 to 2.5 wt %, such as 0.3 to 2.4 wt %. Additionally, in the present disclosure, the content of Mn, Ni and Mo comprised in the martensitic stainless steel is balanced together in order to obtain the desired properties of said martensitic stainless steel.

Chromium (Cr): 11.9 to 14.0 wt %

Cr is one of the basic alloying elements of a stainless steel and an element which will provide corrosion resistance to the steel. The martensitic stainless steel as defined hereinabove or hereinafter comprises at least 11.9 wt % in order to achieve a Cr-oxide layer and/or a passivation of the surface of the steel in air or water, thereby obtaining the basic corrosion resistance. Cr is also a ferrite phase stabilizing alloying element. However, if Cr is present in an excessive amount, the impact toughness may be decreased and additionally ferrite phase and chromium carbides may be formed upon hardening. The formation of chromium carbides will reduce the mechanical properties of the martensitic stainless steel. An increase of the Cr-content above the level for passivation of the steel surface will have only weak effects on the corrosion resistance of the martensitic stainless steel. The Cr-content is therefore set to be at most 14.0 wt %. Hence, the content of Cr is of from 11.9 to 14.0 wt %, such as 12.0 to 13.8 wt %.

Molybdenum (Mo): 0.4 to 1.5 wt %

Mo is a strong ferrite phase stabilizing alloying element and thus promotes the formation of the ferrite phase during annealing or hot-working. One major advantage of Mo is that it contributes strongly to the pitting corrosion resistance. Mo is also known to reduce the temper embrittlement in martensitic steels and thereby improves the mechanical properties. However, Mo is an expensive element and the effect on corrosion resistance is obtained even in low amounts. The lowest content of Mo is therefore 0.4 wt %. Furthermore, an excessive amount of Mo affects the austenite to martensite transformation during hardening and eventually the retained austenite phase content. Therefore, the upper limit of Mo is set at 1.5 wt %. Hence, the content of Mo is of from 0.4 to 1.5 wt %, such as 0.5 to 1.4 wt %.

Nickel (Ni): more than 0.5 to 3.0 wt %

Ni is an austenite phase stabilizing alloying element and thereby stabilize the retained austenite phase after a hardening heat treatment. It has also been discovered that Ni will provide a much improved impact toughness in addition to the general toughness contribution which is provided by the retained austenite phase. In the present disclosure, it has been found that by balancing the amount of Ni, Mn and Mo in the martensitic stainless steel, the best combination of hardness, impact toughness and corrosion resistance will be provided. More than 0.5 wt % Ni is required to provide a substantial effect. However, if the Ni-content is excessive, the amount of retained austenite phase will be too high and the hardness will then be insufficient. The maximum content of Ni is therefore limited to 3.0 wt %. Hence, the content of Ni is from more than 0.5 to 3.0 wt %, such as from more than 0.5 to 2.4 wt %.

Tungsten (W): less than or equal to 0.5 wt %

W is a ferrite phase stabilizing alloying element and if present it may to some extent replace Mo as an alloying element, due to similar chemical properties. W has a positive effect on the resistance against pitting corrosion, but the effect is much weaker than the effect of Mo, if the dissolved matrix contents are compared, which normally is the reason why W is excluded from the PRE-formula. In order to replace Mo, a much higher W-content therefore becomes necessary. W is also a carbide forming element and at high contents of W, the wear resistance will be improved, as well as hardness and strength. However, at W-contents where the above properties are improved, the amount of W-carbides will considerably decrease the impact toughness of the steel. The required W-contents will also result in an increased temperature stability of the carbides, and in order to increase the content of dissolved W in the matrix, much higher hardening temperatures are needed. The content of W is therefore set to be less than or equal to 0.5 wt %, such as less than or equal to 0.05 wt %.

Cobalt (Co): less than or equal to 1.0 wt %,

Cobalt has a strong solid solution effect and gives rise to a strengthening effect, which also remains at higher temperatures. Therefore, Co is often used as an alloying element to improve the high temperature strength, as well as the hardness and resistance to abrasive wear at elevated temperatures. However, at Co-contents where the effects on these properties are significantly improved, the Co-content also has an opposite effect on the hot working properties, causing higher deformation forces. Co is the only alloying element that destabilizes the austenite phase and thus facilitates the transformation of austenite, as well as retained austenite, into martensite phase or ferrite containing phases, on cooling. Due to the complex effects of Co, but also due to the fact that it is toxic, and regarded as an impurity in scrap material used for production of stainless steels intended for atomic energy applications, the content of Co, if present, is therefore set to be less than or equal to 1.0 wt %, such as less than or equal to 0.10 wt %.

Aluminum (Al) less than or equal to 0.050 wt %

Al is an optional element and is commonly used as a deoxidizing agent as it is effective in reducing the oxygen content during steel production. However, a too high content of Al may reduce the mechanical properties. The content of Al is therefore less than or equal to 0.050 wt %.

Nitrogen (N): less than or equal to 0.060 wt %

N is an optional element and is an austenite phase stabilizing alloying element and has a very strong interstitial solid solution strengthening effect. However, a too high content of N may reduce the hot working properties at high temperatures and may also reduce the impact toughness at room temperature for the present martensitic stainless steel. The N-content is therefore set to be less than or equal to 0.060 wt %, such as less than or equal to 0.035 wt %.

Vanadium (V): less than or equal to 0.06 wt %

V is an optional element and is a ferrite phase stabilizing alloying element which has a high affinity to C and N. V is a precipitation hardening element and is regarded as a micro-alloying element in the martensitic stainless steel and may be used for grain refinement. Grain refinement refers to a method to control grain size at high temperatures by introducing small precipitates in the microstructure, which will restrict the mobility of the grain boundaries and thereby will reduce the austenite grain growth during hot working or heat treatment. A small austenite grain size is known to improve the mechanical properties of the martensitic microstructure formed upon hardening. However, an excessive amount of V will generate a too high fraction of precipitates in the microstructure and especially increase the risk of the formation of coarser V precipitations in the prior austenite grain boundaries of the martensitic microstructure, thus reducing the ductility, especially the impact toughness. The content of V is therefore less than or equal to 0.06 wt %.

Niobium (Nb): less than or equal to 0.03 wt %

Nb is an optional element which is a ferrite phase stabilizing alloying element and has a high affinity to C and N. Thus, Nb is a precipitation hardening element and may be used for grain refinement, however, Nb also forms coarse precipitations. An excessive amount of Nb may therefore reduce the ductility and impact toughness of the martensitic stainless steel and the content of Nb therefore is less than or equal to 0.03 wt %.

Zirconium (Zr): less than or equal to 0.03 wt %

Zr is an optional element which has a very high affinity to C and N. Zirconium nitrides and carbides are stable at high temperatures and may be used for grain refinement. If the Zr-content is too high, coarse precipitations may be formed, which will decrease the impact toughness. The content of Zr is therefore less than or equal to 0.03 wt %.

Tantalum (Ta): less than or equal to 0.03 wt %

Ta is an optional element which has a very high affinity to C and N. Tantalum nitrides and carbides are stable at high temperatures and may be used for grain refinement. If the Ta-content is too high, coarse precipitations may be formed, which will decrease the impact toughness. The content of Ta is therefore less than or equal to 0.03 wt %.

Hafnium (Hf): less than or equal to 0.03 wt %

Hf is an optional element which has a very high affinity to C and N. Hafnium nitrides and carbides are stable at high temperatures and may be used for grain refinement. If the Hf-content is too high, coarse precipitations may be formed, which will decrease the impact toughness. The content of Hf is therefore less than or equal to 0.03 wt %.

Phosphorous (P): less than or equal to 0.03 wt %

P is an optional element and may be included as an impurity and is regarded as a harmful element. Therefore, it is desirable to have less than 0.03 wt % P.

Sulphur (S): less than or equal to 0.05 wt %

S is an optional element and may be included in order to improve the machinability. However, S may form grain boundary segregations and inclusions and will therefore restrict the hot working properties and also reduce the mechanical properties and corrosion resistance. Hence, the content of S should not exceed 0.05 wt %.

Titanium (Ti): less than or equal to 0.05 wt %

Ti is an optional element which is a ferrite phase stabilizing alloying element and has a very high affinity to C and N. Titanium nitrides and carbides are stable at high temperatures and may be used for grain refinement. If the Ti-content is too high, coarse precipitations may be formed, which will decrease the impact toughness. The content of Ti is therefore less than or equal to 0.05 wt %.

Copper (Cu) less than or equal to 1.2 wt %

Cu is an austenite phase stabilizing alloying element and has rather limited effects on the martensitic stainless steel in small amounts. Cu may to some extent replace Ni or Mn as austenite phase stabilizers in the martensitic stainless steel but the ductility will then be reduced compared to e.g. an addition of Ni. Cu may have a positive effect on the general corrosion resistance of the steel but higher amounts of Cu will affect the hot working properties negatively. The content of Cu is therefore less than or equal to 1.2 wt %, such as less than or equal to 0.8 wt %.

Optionally small amounts of other alloying elements may be added to the martensitic stainless steel as defined hereinabove or hereinafter in order to improve e.g. the machinability or the hot working properties, such as the hot ductility. Example, but not limiting, of such elements are Ca, Mg, B, Pb and Ce. The amounts of one or more of these elements are of max. 0.05 wt %.

When the terms "max" or "less than or equal to" are used, the skilled person knows that the lower limit of the range is 0 wt % unless another number is specifically stated.

The remainder of elements of the martensitic stainless steel as defined hereinabove or hereinafter is Iron (Fe) and normally occurring impurities.

Examples of impurities are elements and compounds which have not been added on purpose, but cannot be fully avoided as they normally occur as impurities in e.g. the raw material or the additional alloying elements used for manufacturing of the martensitic stainless steel.

According to one embodiment of the present disclosure, the chemical composition of the martensitic stainless steel as defined hereinabove or hereinafter may be represented by an area in a Schaeffler diagram defined by the following coordinates (see FIG. 1 and FIG. 2):

| | $Cr_{eq}$ | $Ni_{eq}$ |
|---|---|---|
| A2 | 12.923 | 9.105 |
| B2 | 12.923 | 11.479 |
| B4 | 15.702 | 9.199 |
| A3 | 14.482 | 7.864. |

According to one embodiment of the present disclosure, the chemical composition of the martensitic stainless steel as defined hereinabove or hereinafter may be represented by an area in a Schaeffler diagram defined by the following coordinates (see FIG. 1 and FIG. 2):

| | $Cr_{eq}$ | $Ni_{eq}$ |
|---|---|---|
| A1 | 12.300 | 9.602 |
| B1 | 12.300 | 11.990 |
| B3 | 14.482 | 10.200 |
| A3 | 14.482 | 7.864. |

According to a further embodiment of the present disclosure, the chemical composition of the martensitic stainless steel as defined hereinabove or hereinafter may be represented by an area in a Schaeffler diagram defined by the following coordinates (see FIG. 1 and FIG. 2):

| | $Cr_{eq}$ | $Ni_{eq}$ |
|---|---|---|
| A2 | 12.923 | 9.105 |
| B2 | 12.923 | 11.479 |
| B3 | 14.482 | 10.200 |
| A3 | 14.482 | 7.864. |

The martensitic stainless steel as defined hereinabove or hereinafter and the drill rod manufactured thereof are made by conventional steel production and steel machining processes and conventional drill rod production and drill rod machining processes. In order to obtain the desired martensitic structure, the martensitic stainless steel has to be hardened and tempered. The mechanical properties of the surface may be further improved by induction heating of the surface or by applying surface treatment methods, such as but not limited to shot peening. The obtained martensitic steel and/or objects made thereof will have good corrosion resistance in combination with optimized and well-balanced mechanical properties, such as high hardness, resistance against wear and abrasion, high tensile strength and high impact toughness.

The martensitic stainless steel according to the present disclosure is intended, as mentioned herein, for manufacturing of drill rods, such as top hammer drill rods. The martensitic stainless steel according to the present disclosure will provide the drill rods with high hardness, resistance against wear and abrasion, high tensile strength, high impact toughness and good corrosion resistance, it should be noted that there are today no drill rods commercially available, which are made of stainless steel.

Hence, the present disclosure also relates to a drill rod comprising the martensitic stainless steel as defined hereinabove or hereinafter, which will have all the properties mentioned above, i.e. having a combination of good corrosion resistance and optimized and well-balanced mechanical properties.

The present disclosure is further illustrated by the following non-limiting examples.

EXAMPLES

Example 1

The alloys of Example 1 have been produced by melting in a high frequency furnace and thereafter ingot cast using 9" steel moulds. The weights of the ingots were approximately 270 kg. The ingots were heat-treated by soft annealing at 650° C. for 4 hours and then air cooled to room temperature followed by grinding of the ingot surface.

After the heat treatment, the ingots were forged in a hammer to bars having a round dimension of approximately 145 mm. The obtained round bars were then hot rolled at 1200° C. in a rolling mill to solid hexagonal 35 mm dimension.

Samples from these bars were used for corrosion and mechanical testing.

The chemical composition of the different alloys and their corresponding alloy No. is found in Table 1. Alloys outside the scope of the disclosure are marked with an "x" in all tables.

The Cr- and Ni-equivalents, i.e. the $Cr_{eq}$ and the $Ni_{eq}$ values, for all alloys of the examples are shown in Table 2 and in FIG. 2. The $Cr_{eq}$ and the $Ni_{eq}$ values have been calculated according to the formulas given above in the present disclosure. The PRE-values for each alloy were calculated according to the following equation: PRE=Cr (wt %)+3.3*Mo (wt %).

The corrosion testing was performed by dynamic polarization measurements, either by (Corr 1) immersing a sample in a NaCl-solution (600 mg/l) at room temperature using a voltage scan rate of 10 mV/min, or by (Corr 2) immersing a sample in a NaCl-solution (600 mg/l) at room temperature using a voltage scan rate of 75 mV/min. The breakthrough potential, Ep (V), of the passive oxide film on the steel surface was then measured. The results are based on the average of two samples for each alloy. Before corrosion testing, all samples had been hardened at 1030-1050° C./0.5 h, quenched in oil, and tempered at 200-225° C./1 h. The result of the corrosion testing is shown in Table 2.

Mechanical testing in the form of hardness testing (HRC) and impact toughness testing on notched Charpy-V samples with the dimensions of 10×10×55 mm, was performed at room temperature on all alloys. The samples were hardened at 1030° C./0.5 h[1)] or 1050° C./1h[2)], quenched in oil and thereafter tempered at different temperatures, 175-275° C. for 1 h. The results of the as-hardened conditions are based on the average of two Charpy-V samples, while the results of the tempered conditions are based on the average of three Charpy-V samples.

The result of the mechanical testing is shown in Tables 3A and 3B.

Table 4 summarizes a relative ranking of the hot working properties, mechanical properties and the corrosion resistance, based on the experiences during the manufacturing and testing of the alloys of the Example.

TABLE 1

Chemical composition in weight % (wt %).

| Alloy | 11 x | 12 x | 13 x | 14 x | 15 x | 26 x | 27 x | 28 x | 29 x | 210 x | HT 91 x | 31 x | 32 x |
|---|---|---|---|---|---|---|---|---|---|---|---|---|---|
| C | 0.19 | 0.18 | 0.17 | 0.17 | 0.16 | 0.20 | 0.20 | 0.15 | 0.17 | 0.16 | 0.20 | 0.25 | 0.23 |
| Si | 0.27 | 0.28 | 0.24 | 0.17 | 0.30 | 0.33 | 1.26 | 0.32 | 0.40 | 0.69 | 0.44 | 0.29 | 0.92 |

TABLE 1-continued

Chemical composition in weight % (wt %).

| | | | | | | | | | | | | | |
|---|---|---|---|---|---|---|---|---|---|---|---|---|---|
| Mn | 0.40 | 0.50 | 0.48 | 0.50 | 0.48 | 0.46 | 0.52 | 0.51 | 0.48 | 0.78 | 0.49 | 0.44 | 0.44 |
| P | 0.004 | 0.004 | 0.003 | 0.004 | 0.005 | 0.004 | 0.007 | 0.004 | 0.004 | 0.004 | 0.014 | 0.006 | 0.006 |
| S | 0.006 | 0.007 | 0.007 | 0.007 | 0.007 | 0.005 | 0.007 | 0.007 | 0.006 | 0.007 | 0.007 | 0.005 | 0.004 |
| Cr | 13.15 | 13.09 | 12.06 | 13.15 | 12.72 | 13.24 | 12.71 | 13.39 | 11.36 | 11.57 | 11.35 | 13.43 | 12.64 |
| Ni | 0.29 | 0.03 | 0.41 | 0.43 | 3.82 | 0.03 | 0.42 | 0.22 | 0.64 | 0.58 | 0.53 | 0.30 | 0.26 |
| Co | — | <0.01 | <0.01 | <0.01 | — | <0.01 | <0.01 | <0.01 | <0.01 | <0.01 | — | <0.01 | <0.01 |
| Mo | <0.01 | <0.01 | 0.82 | <0.01 | 0.19 | <0.01 | <0.01 | <0.01 | 0.71 | 0.67 | 0.98 | <0.01 | <0.01 |
| W | <0.01 | <0.01 | <0.01 | <0.01 | <0.01 | <0.01 | <0.01 | 0.01 | <0.01 | <0.01 | — | <0.01 | <0.01 |
| Nb | <0.03 | <0.03 | <0.03 | <0.03 | <0.03 | <0.03 | <0.03 | <0.03 | 0.18 | <0.01 | <0.03 | <0.01 | <0.01 |
| N | 0.014 | 0.028 | 0.018 | 0.048 | 0.020 | 0.027 | 0.026 | 0.082 | 0.063 | 0.061 | 0.030 | 0.036 | 0.012 |
| Ti | <0.005 | <0.005 | <0.005 | <0.003 | <0.003 | <0.005 | <0.003 | <0.003 | <0.005 | <0.005 | <0.05 | <0.005 | <0.005 |
| Cu | 0.005 | 0.006 | 0.006 | <0.010 | 0.096 | 1.81 | <0.010 | <0.010 | 0.009 | 0.30 | 0.05 | 0.006 | 0.007 |
| Al | <0.003 | <0.003 | <0.003 | <0.003 | <0.003 | <0.003 | <0.003 | <0.003 | 0.004 | 0.005 | <0.05 | 0.026 | <0.003 |
| V | 0.008 | 0.005 | 0.005 | 0.34 | 0.015 | 0.005 | 0.18 | 0.010 | 0.31 | 0.14 | 0.27 | 0.014 | 0.015 |

| Alloy | 33 x | 34 x | 35 x | 36 x | 37 | 38 x | 41 x | 42 | 43 | 44 | 45 |
|---|---|---|---|---|---|---|---|---|---|---|---|
| C | 0.24 | 0.24 | 0.22 | 0.23 | 0.23 | 0.26 | 0.24 | 0.21 | 0.24 | 0.24 | 0.23 |
| Si | 0.33 | 0.32 | 0.19 | 0.26 | 0.21 | 0.50 | 0.03 | 0.02 | 0.02 | 0.04 | 0.04 |
| Mn | 3.56 | 0.48 | 0.40 | 0.43 | 0.44 | 0.63 | 2.08 | 0.54 | 1.20 | 2.31 | 0.56 |
| P | 0.007 | 0.006 | 0.007 | 0.006 | 0.006 | 0.007 | 0.005 | 0.005 | 0.005 | 0.004 | 0.004 |
| S | 0.005 | 0.005 | 0.006 | 0.005 | 0.005 | 0.005 | 0.007 | 0.006 | 0.007 | 0.006 | 0.007 |
| Cr | 13.43 | 13.25 | 11.86 | 11.91 | 12.58 | 12.97 | 13.22 | 13.04 | 12.62 | 12.39 | 12.49 |
| Ni | 0.04 | 4.11 | 1.90 | 0.05 | 1.11 | 0.50 | 0.50 | 2.11 | 1.34 | 0.52 | 2.13 |
| Co | <0.01 | <0.01 | <0.01 | <0.01 | <0.01 | <0.01 | <0.01 | — | — | — | <0.01 |
| Mo | <0.01 | <0.01 | 1.20 | 1.21 | 0.91 | 0.90 | 0.50 | 0.50 | 0.99 | 1.18 | 1.24 |
| W | <0.01 | <0.01 | <0.01 | <0.01 | <0.01 | <0.01 | 0.01 | — | — | — | <0.01 |
| Nb | <0.01 | <0.01 | <0.01 | <0.01 | <0.01 | <0.01 | <0.01 | <0.01 | <0.01 | <0.01 | <0.01 |
| N | 0.015 | 0.015 | 0.014 | 0.013 | 0.014 | 0.065 | 0.019 | 0.018 | 0.022 | 0.019 | 0.016 |
| Ti | <0.003 | <0.003 | <0.003 | <0.003 | <0.003 | <0.003 | <0.003 | <0.003 | <0.003 | <0.003 | <0.003 |
| Cu | <0.010 | <0.010 | <0.010 | 1.30 | 0.70 | 0.017 | <0.010 | <0.010 | <0.010 | <0.010 | <0.010 |
| Al | <0.003 | <0.003 | <0.003 | <0.003 | <0.003 | <0.003 | <0.003 | <0.003 | 0.003 | 0.010 | 0.014 |
| V | 0.015 | 0.013 | 0.013 | 0.015 | 0.014 | 0.016 | 0.007 | 0.007 | 0.006 | 0.007 | 0.007 |

TABLE 2

$Cr_{eq}$, $Ni_{eq}$, PRE and Corrosion results, Ep (V).

| Alloy | 11 x | 12 x | 13 x | 14 x | 15 x | 26 x | 27 x | 28 x | 29 x | 210 x | HT 91 x | 31 x | 32 x |
|---|---|---|---|---|---|---|---|---|---|---|---|---|---|
| $Cr_{eq}$ | 13.56 | 13.51 | 13.24 | 13.41 | 13.36 | 13.74 | 14.60 | 13.87 | 12.76 | 13.28 | 12.99 | 13.87 | 14.02 |
| $Ni_{eq}$ | 6.61 | 6.52 | 6.29 | 7.22 | 9.46 | 7.07 | 7.46 | 7.44 | 7.87 | 7.60 | 7.68 | 9.10 | 7.74 |
| PRE | 13.2 | 13.1 | 14.8 | 13.2 | 13.3 | 13.2 | 12.7 | 13.4 | 13.7 | 13.8 | 14.6 | 13.4 | 12.6 |
| Corr 1 | — | — | 0.44 | — | — | 0.44 | 0.43 | 0.46 | — | — | 0.42 | — | — |
| Corr 2 | — | — | — | — | — | — | — | — | — | — | — | — | — |

| Alloy | 33 x | 34 x | 35 x | 36 x | 37 | 38 x | 41 x | 42 | 43 | 44 | 45 |
|---|---|---|---|---|---|---|---|---|---|---|---|
| $Cr_{eq}$ | 13.93 | 13.73 | 13.35 | 13.51 | 13.81 | 14.62 | 13.77 | 13.57 | 13.64 | 13.63 | 13.79 |
| $Ni_{eq}$ | 9.47 | 12.00 | 9.12 | 7.56 | 8.65 | 10.57 | 9.31 | 9.22 | 9.80 | 9.45 | 9.79 |
| PRE | 13.4 | 13.3 | 15.8 | 15.9 | 15.6 | 15.9 | 14.9 | 14.7 | 15.9 | 16.3 | 16.6 |
| Corr 1 | 0.50 | — | 0.34 | — | — | — | — | — | 0.465 | — | — |
| Corr 2 | — | — | — | — | — | — | 0.373 | 0.418 | 0.490 | 0.494 | 0.616 |

TABLE 3A

Hardness results (HRC) at room temperature after hardening and tempering at different tempering temperatures.

| Alloy | 11 1) x | 12 1) x | 13 1) x | 14 1) x | 15 1) x | 26 1) x | 27 1) x | 28 1) x | 29 1) x | 210 1) x | HT 91 1) x | 31 2) x | 32 2) x |
|---|---|---|---|---|---|---|---|---|---|---|---|---|---|
| As-hardened | 51.0 | 51.6 | 49.1 | 51.8 | 49.0 | 53.6 | 51.6 | 51.7 | 53.3 | 52.3 | — | 57.3 | 55.7 |
| 175° C. | 48.6 | 49.9 | 48.2 | 50.0 | 46.3 | 50.3 | 50.0 | 50.0 | 51.1 | 50.2 | 48.5 | 54.3 | 53.0 |
| 225° C. | 45.0 | 46.5 | 45.9 | 46.9 | 42.4 | 46.2 | 48.1 | 46.8 | 48.4 | 48.1 | 47.5 | 50.3 | 49.8 |
| 250° C. | — | — | — | — | — | — | — | — | — | — | — | — | — |
| 275° C. | 40.7 | 43.6 | 43.3 | 44.2 | 40.9 | 43.3 | 46.1 | 44.7 | 47.0 | 46.1 | 45.1 | 47.1 | 48.7 |

| Alloy | 33 2 x) | 34 2) x | 35 2) x | 36 2) x | 37 2) | 38 2 x) | 41 2) x | 42 2) | 43 2) | 44 2) | 45 2) |
|---|---|---|---|---|---|---|---|---|---|---|---|
| As-hardened | 54.6 | 49.5 | 55.1 | 54.9 | 54.8 | 56.0 | 54.8 | 53.2 | 54.2 | 54.0 | 53.8 |
| 175° C. | 52.5 | 47.6 | 52.0 | 52.1 | 52.0 | 55.2 | 51.8 | 51.0 | 51.5 | 51.3 | 51.0 |
| 225° C. | 49.0 | 45.3 | 48.5 | 48.0 | 48.4 | 52.9 | 47.8 | 47.0 | 47.3 | 47.5 | 47.2 |

TABLE 3A-continued

| Hardness results (HRC) at room temperature after hardening and tempering at different tempering temperatures. | | | | | | | | | | | |
|---|---|---|---|---|---|---|---|---|---|---|---|
| 250° C. | — | — | — | — | — | — | 45.4 | 45.0 | 45.5 | 46.0 | 45.5 |
| 275° C. | 46.1 | 43.0 | 45.8 | 45.9 | 45.6 | 50.9 | 45.2 | 45.0 | 44.8 | 45.5 | 45.0 |

TABLE 3B

| Impact Toughness results, Charpy-V (J), at room temperature after hardening and tempering at different tempering temperatures. | | | | | | | | | | | | | |
|---|---|---|---|---|---|---|---|---|---|---|---|---|---|
| Alloy | 11[1) x] | 12[1) x] | 13[1) x] | 14[1) x] | 15[1) x] | 26[1) x] | 27[1) x] | 28[1) x] | 29[1) x] | 210[1) x] | HT 91[1) x] | 31[2) x] | 32[2) x] |
| As-hardened | 3.4 | 3.9 | 6.0 | 6.4 | 15.8 | 7.0 | 9.0 | 8.0 | 6.0 | 6.0 | — | 3.7 | 3.9 |
| 175° C. | 27.0 | 27.1 | 32.4 | 11.4 | 47.2 | 17.7 | 15.7 | 14.0 | 23.0 | 14.7 | 21.0 | 7.9 | 19.5 |
| 225° C. | 40.2 | 33.4 | 47.2 | 25.2 | 56.0 | 42.7 | 26.7 | 30.7 | 37.7 | 19.3 | 34.5 | 27.1 | 36.6 |
| 250° C. | — | — | — | — | — | — | — | — | — | — | — | — | — |
| 275° C. | 36.3 | 33.8 | 42.7 | 25.7 | 58.7 | 43.0 | 28.3 | 35.0 | 30.0 | 16.0 | 38.8 | 35.1 | 38.1 |
| Alloy | 33[2) x] | 34[2) x] | 35[2) x] | 36[2) x] | 37[2)] | 38[2) x] | 41[2) x] | 42[2)] | 43[2)] | 44[2)] | 45[2)] | | |
| As-hardened | 5.5 | 16.2 | 5.4 | 4.5 | 4.2 | 3.7 | 5.2 | 5.2 | 4.6 | 3.5 | 4.1 | | |
| 175° C. | 25.5 | 35.7 | 33.8 | 17.8 | 24.0 | 6.5 | 12.5 | 34.0 | 27.9 | 27.2 | 33.1 | | |
| 225° C. | 43.3 | 42.1 | 47.5 | 36.0 | 43.8 | 25.4 | 47.7 | 54.2 | 51.0 | 61.2 | 56.8 | | |
| 250° C. | — | — | — | — | — | — | 49.2 | 56.3 | 56.0 | 60.4 | 65.5 | | |
| 275° C. | 50.8 | 50.0 | 49.2 | 42.2 | 46.3 | 25.7 | 48.4 | 56.4 | 55.1 | 63.4 | 64.9 | | |

TABLE 4

| Relative ranking of the alloys of the Example. | | | | | | | | | | | | |
|---|---|---|---|---|---|---|---|---|---|---|---|---|
| Alloy | 11 [x] | 12 [x] | 13 [x] | 14 [x] | 15 [x] | 26 [x] | 27 [x] | 28 [x] | 29 [x] | 210 [x] | HT 91 [x] | 31 [x] |
| Hot working Properties | Average | Average | Average | Average | Average | Average | Average | Average | Average | Average | — | Excellent |
| Mechanical Properties | Average | Average | Better | Poorer | Better | Average | Poorer | Poorer | Better | Worst | Average | Average |
| Corrosion Resistance | — | — | Better | — | — | Better | Better | Best | — | — | Better | — |
| Alloy | 32 [x] | 33 [x] | 34 [x] | 35 [x] | 36 [x] | 37 | 38 [x] | 41 [x] | 42 | 43 | 44 | 45 |
| Hot working Properties | Better | Poorer | Excellent | Best | Poorer | Best | Better | Best | Best | Best | Best | Excellent |
| Mechanical Properties | Better | Best | Better | Best | Better | Best | Poorer | Better | Best | Best | Excellent | Excellent |
| Corrosion Resistance | — | Best | — | Average | — | — | — | Average | Better | Best | Best | Excellent |

The invention claimed is:

1. A martensitic stainless steel comprising in weight % (wt %):

C 0.21 to 0.27;

Si less than or equal to 0.7;

Mn 0.2 to 2.5;

P less than or equal to 0.03;

S less than or equal to 0.05;

Cr 11.9 to 14.0;

Ni 1.9 to 3.0;

Mo 0.4 to 1.5;

N less than or equal to 0.016;

Cu less than or equal to 1.2;

V less than or equal to 0.06;

Nb less than or equal to 0.03;

Al less than or equal to 0.050;

Ti less than or equal to 0.05;

balance Fe and unavoidable impurities, wherein the martensitic stainless steel comprises more than or equal to 75% martensite phase and less than or equal to 25% retained austenite phase, wherein said martensitic stainless steel has a PRE-value more than or equal to 14, and wherein the chemical composition of the said martensitic stainless steel is within an area formed in a Schaeffler diagram, which diagram is based on the following equations:

$$Cr_{eq}=Cr+Mo+1.5*Si+0.5*Nb(x\text{-axis})$$

$$Ni_{eq}=Ni+0.5*Mn+30*N+30*C(y\text{-axis})$$

wherein the values of Cr, Mo, Si, Nb, Ni, Mn, N and C are in weight %, and wherein the area is defined by the following coordinates:

| | $Cr_{eq}$ | $Ni_{eq}$ |
|---|---|---|
| A1 | 12.300 | 9.602 |
| B1 | 12.300 | 11.990 |
| B4 | 15.702 | 9.199 |
| A3 | 14.482 | 7.864. |

2. The martensitic stainless steel according to claim 1, wherein said martensitic stainless steel comprises of from 80 to 95% martensite phase and of from 5 to 20% retained austenite phase.

3. The martensitic stainless steel according to claim 1, wherein the content of Si is less than or equal to 0.4 wt %.

4. The martensitic stainless steel according to claim 1, wherein the content of N is 0.012-0.016 wt %.

5. The martensitic stainless steel according to claim 1, wherein the content of Cu is less than or equal to 0.8 wt %.

6. The martensitic stainless steel according to claim 1, wherein the content of C is of from 0.21 to 0.26 wt %.

7. The martensitic stainless steel according to claim 1, wherein the content of Cr is of from 12.0 to 13.8 wt %.

8. The martensitic stainless steel according to claim 1, wherein the content of Mn is of from 0.3 to 2.4 wt %.

9. The martensitic stainless steel according to claim 1, wherein the content of Ni is 1.9 to 2.4 wt %.

10. The martensitic stainless steel according to claim 1, wherein the content of Mo is of from 0.5 to 1.4 wt %.

11. The martensitic stainless steel according to claim 1, wherein the area is defined by the following coordinates:

| | $Cr_{eq}$ | $Ni_{eq}$ |
|---|---|---|
| A2 | 12.923 | 9.105 |
| B2 | 12.923 | 11.479 |
| B4 | 15.702 | 9.199 |
| A3 | 14.482 | 7.864. |

12. The martensitic stainless steel according to claim 1, wherein the area is defined by the following coordinates:

| | $Cr_{eq}$ | $Ni_{eq}$ |
|---|---|---|
| A1 | 12.300 | 9.602 |
| B1 | 12.300 | 11.990 |
| B3 | 14.482 | 10.200 |
| A3 | 14.482 | 7.864. |

13. The martensitic stainless steel according to claim 1, wherein the area is defined by the following coordinates:

| | $Cr_{eq}$ | $Ni_{eq}$ |
|---|---|---|
| A2 | 12.923 | 9.105 |
| B2 | 12.923 | 11.479 |
| B3 | 14.482 | 10.200 |
| A3 | 14.482 | 7.864. |

14. The martensitic stainless steel according to claim 1, wherein the martensitic stainless steel does not contain any ferrite after hardening.

15. The martensitic stainless steel according to claim 1, further comprising in weight % (wt %):

W less than or equal to 0.5;
Co less than or equal to 1.0;
Zr less than or equal to 0.03;
Ta less than or equal to 0.03; and
Hf less than or equal to 0.03.

16. The martensitic stainless steel according to claim 1, comprising in weight % (wt %):

C 0.21 to 0.27;
Si 0.02 to 0.5;
Mn 0.2 to 2.5;
P less than or equal to 0.03;
S less than or equal to 0.05;
Cr 11.9 to 13.43;
Ni 1.9 to 3.0;
Mo 0.5 to 1.24;
N less than or equal to 0.016;
Cu less than or equal to 0.7;
V less than or equal to 0.06;
Nb less than or equal to 0.03;
Al less than or equal to 0.050;
Ti less than or equal to 0.05;
balance Fe and unavoidable impurities.

17. The martensitic stainless steel according to claim 16, further comprising in weight % (wt %):

W less than or equal to 0.5;
Co less than or equal to 1.0;
Zr less than or equal to 0.03;
Ta less than or equal to 0.03; and
Hf less than or equal to 0.03.

18. The martensitic stainless steel according to claim 16, wherein said martensitic stainless steel comprises of from 80 to 95% martensite phase, of from 5 to 20% retained austenite phase, and does not contain any ferrite phase.

* * * * *